US006223659B1

(12) United States Patent
Garcia et al.

(10) Patent No.: US 6,223,659 B1
(45) Date of Patent: May 1, 2001

(54) LINE STORAGE DEVICE FOR PREVENTING LINE ENTANGLEMENT

(75) Inventors: Felipe Garcia, Panama City; Robert Woodall, Lynn Haven; Gilberto Irizarry, Panama City Beach, all of FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/081,715

(22) Filed: May 18, 1998

(51) Int. Cl.[7] ..... F42B 15/04
(52) U.S. Cl. ..... 102/504; 89/1.34
(58) Field of Search ..... 102/504, 505, 102/275.7; 89/1.34, 1.811

(56) References Cited

U.S. PATENT DOCUMENTS

| | | | | |
|---|---|---|---|---|
| 1,247,331 | * | 11/1917 | Robinson | 102/504 |
| 3,266,423 | * | 8/1966 | Simpson | 102/504 |
| 3,319,781 | * | 5/1967 | Simpson et al. | 102/504 |
| 4,903,607 | * | 2/1990 | Clark | 102/504 |
| 5,035,169 | * | 7/1991 | Chapin et al. | 89/1.34 |
| 5,167,382 | * | 12/1992 | Rochester et al. | 89/1.34 |
| 5,458,708 | * | 10/1995 | Gardner et al. | 156/64 |
| 5,750,918 | * | 5/1998 | Mangolds et al. | 102/504 |

FOREIGN PATENT DOCUMENTS

| | | | | |
|---|---|---|---|---|
| 2753494 | * | 6/1979 | (DE) | 102/504 |
| 2757250 | * | 6/1979 | (DE) | 102/504 |
| 45377 | * | 7/1935 | (FR) | 102/504 |
| 821527 | * | 12/1937 | (FR) | 102/505 |
| 328784 | * | 8/1936 | (IT) | 102/504 |

* cited by examiner

*Primary Examiner*—Stephen M. Johnson
(74) *Attorney, Agent, or Firm*—Harvey A. Gilbert; Donald G. Peck

(57) ABSTRACT

A line storage device prevents a line from becoming entangled. A channel formed in a piece of material defines a non-overlapping zigzag pattern. The line is laid in the channel and extends from opposing ends of the piece of material. The material supports the line in the channel until the line attains a threshold tension at which point the piece ruptures sequentially along the zigzag pattern from each opposing end. The channel can be formed in or on one or more surfaces of the piece of material.

22 Claims, 1 Drawing Sheet

LINE STORAGE DEVICE FOR PREVENTING LINE ENTANGLEMENT

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to anti-entanglement of lines, and more particularly to a device that prevents a line from becoming entangled during storage and during the payout thereof under tension.

BACKGROUND OF THE INVENTION

Systems requiring the payout of feed line during deployment typically present a potential feed line entanglement problem. An example of one such system is the U.S. Navy's anti-personnel obstacle breaching system (APOBS) disclosed in "Reliable and Effective Line Charge System," U.S. patent application Ser. No. 09/12,932, filed on Jan. 24, 1998. Briefly, the APOBS is a portable explosive line charge system used for mine and obstacle neutralization. The system includes a rocket tethered by a line to a series of charges distributed in a spaced-apart fashion along a detonation cord.

As witnessed during developmental testing, the line experiences standing wave motion as the rocket propels itself down range. The distributed line charge moves through the standing wave similar to the way a wave travels down a rope that has been whipped up and down. However, rather than the wave moving through the distributed line charge, the distributed line charge moves through the wave as it flies down range. This gives the appearance that the wave is stationary above the ground and along the flight path. The standing wave causes the line to whip the distributed line charge and create acceleration loads that act in multiple directions which tend to cause line charge fuze failure, charge rupture and general entanglement of both the line and distributed line charge.

SUMMARY OF THE INVENTION

Accordingly, it is an object of the present invention to provide a device that prevents a system's feed line from becoming entangled prior to and during deployment.

Another object of the present invention is to provide a device that prevents entanglement of a tensioned line that is attached on a first end thereof to a propulsion unit and attached on a second end thereof to a distributed mass.

Other objects and advantages of the present invention will become more obvious hereinafter in the specification and drawings.

In accordance with the present invention, a line storage device prevents a line from becoming entangled. At least one piece of material is formed with a channel that receives a line therein. The channel defines a non-overlapping zigzag pattern such that the line extends from opposing ends of the piece of material. The material supports the line in the channel until the line extending from the opposing ends attains a threshold tension at which point the piece ruptures sequentially along the zigzag pattern from each opposing end. The channel can be formed in or on one or more surfaces of the piece of material.

BRIEF DESCRIPTION OF THE INVENTION

DETAILED DESCRIPTION OF THE INVENTION

Figure 1:
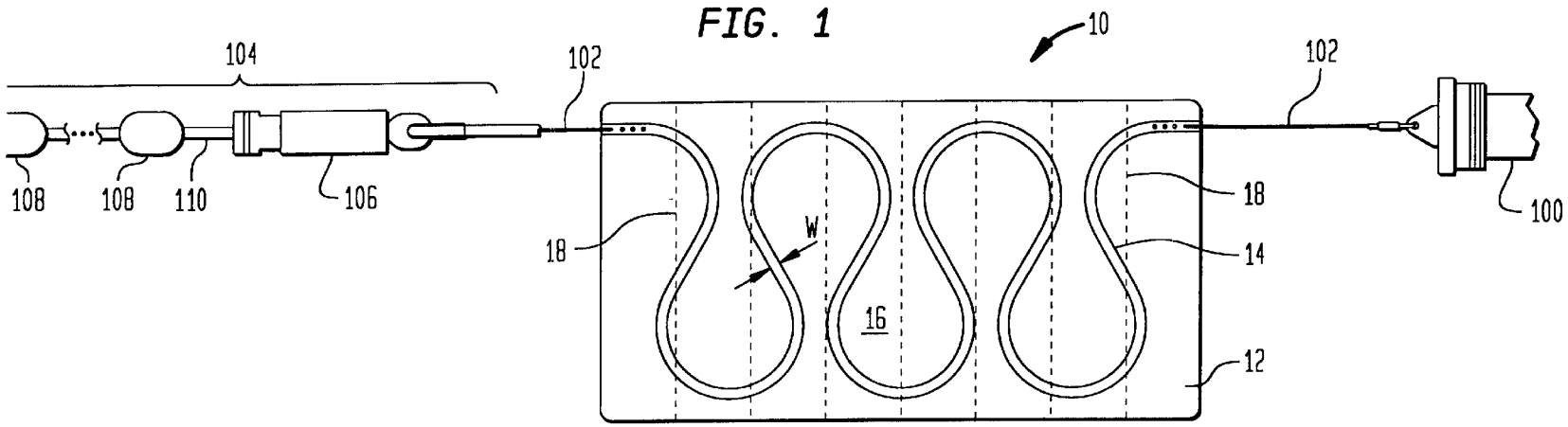
FIG. 1 is a plan view of one embodiment of the line storage device of the present invention used to store line that is to be paid out between a rocket propulsion unit and distributed line charges.

Referring now to the drawings, and more particularly to FIG. 1, one embodiment of the line storage device in accordance with the present invention is shown and referenced generally by numeral 10. By way of example, line storage device 10 will be described for its use with a rocket-deployed line charge system, the basic elements of which are illustrated in FIG. 1. However, it is to be understood that line storage device 10 can be used with any similar line charge or other deployment system having a propulsion unit tethered to a distributed and tethered set of individual masses. More generally, the present invention will also be of use in any system requiring the storage of excess line and tangle-free payout of the line as is the case with a parachute system.

In terms of the illustrated line charge system, a rocket 100 has a line 102 coupled on one end thereof to an aft end of rocket 100. The other end of line 102 is coupled to the forward end of distributed line charge 104. Briefly, line charge 104 includes a fuze or detonator 106 coupled to a plurality of distributed explosive charges 108 by means a detonating cord 110. A substantial amount of line 102 (e.g., eight feet or more) extends between rocket 100 and fuze 106. For proper operation of line charge 104, rocket 100 must travel down range with line 102 being paid out thereafter. Payout of line 102 must be tangle-free in order to assure proper placement of line charge 104 and activation of fuze 106. That is, if line 102 becomes entangled with itself during payout, line charge 104 may not be placed in its anticipated location. If line 102 becomes entangled with line charge 104, failure of fuze 106 as well as inaccurate placement of line charge 104 can result. Accordingly, it is necessary to store line 102 in a tangle-free fashion as well as provide for its payout in a tangle-free fashion.

To achieve tangle-free storage and payout of line 102, line storage device 10 is provided. In the embodiment illustrated in FIG. 1, line storage device 10 is a piece or block 12 of material having a channel 14 formed in a surface 16 thereof. Channel 14 is laid out in a non-overlapping zigzag pattern over the length of block 12. Laid into channel 14 is the excess amount of line 102 between rocket 100 and fuze 106. The width W of channel 14 can be formed so that line 102 and channel 14 are in press-fit engagement. Alteratively or additionally, line 102 can be secured in channel 14 by, for example, a light tacking glue (not shown) or by tape covering channel 14 and adhered to surface 16. Such tape can be wrapped about block 12. The optional tape feature is illustrated in FIG. 1 by dashed lines 18 which indicate the edges of the wrapped tape.

Channel 14 is accessed from either end of block 12 so that line 102 can extend from either end of block 12. The zigzag pattern presented by channel 14 can be any nonoverlapping zigzag pattern into which line 102 can be nondestructively formed.

Block 12 is made from a material that supports line 102 prior to the deployment of line charge 104 and that fails or ruptures during the deployment of line charge 104. By doing so, the present invention provides a means to absorb and release launch energy that produces a standing wave in line 102 as discussed above in the Background of the Invention. More specifically, when rocket 100 begins to travel down range, line 102 between rocket 100 and line storage device 10 is placed in tension by the forward momentum of rocket 100 and the resting weight of line charge 104. As line 102 is pulled taut at block 12 by rocket 100 at one end and by line charge 104 at the other end, line 102 exerts force on each successive "loop" formed by channel 14 in block 12. Due to the extreme tensile force, block 12 ruptures sequentially from both ends thereof at each successive loop of channel 14 effectively paying out line 102 while insuring against entanglement and absorbing/releasing launch energy to reduce the loading imparted by the standing wave. The energy is released during the sequential rupturing of block 12.

To support line 102 prior to deployment and failure at time of deployment as described above, block 12 is made from a solid material that will rupture as line 102 achieves a threshold tension. One suitable material is polystyrene which is lightweight, inexpensive, easily formed in terms of both overall shape and channel 14, and is readily ruptured when line 102 achieves its threshold tension. Other suitable materials include plaster and low density frangible plastics such as polypropylene, acrylic, vinyl, polyvinyl chloride and cellulose acetate just to name a few. Block 12 can be formed from a piece of the selected stock material or could be molded into its specific shape and size. Block 12 could also be formed or molded about a pre-shaped zigzag pattern of line 102 to thereby fully encase line 102 in block 12.

If there is a substantial amount of line 102 that must be stored or if the overall size of block 12 is of concern, the present invention can be extended to store parallel layers of line 102. For example, line storage device 20 shown in top and bottom plan view in FIGS. 2A and 2B, respectively, creates two layers of channels for storing line 102. However, as will be appreciated by one of ordinary skill in the art, the following two-layer description can easily be extended to three or more layers.

Figure 2B:
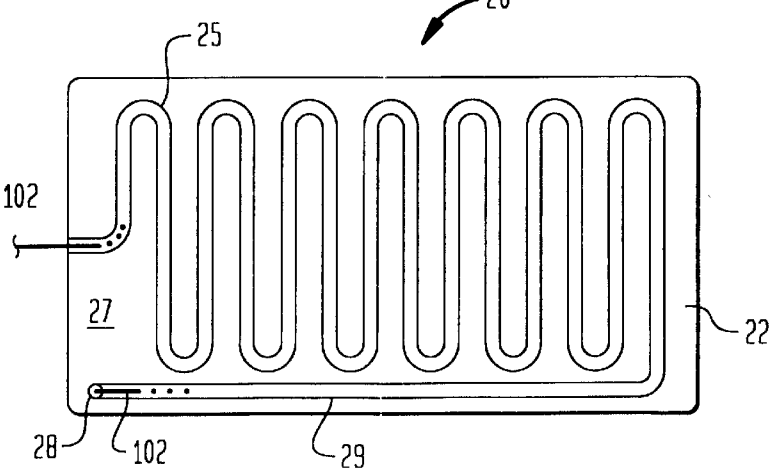
FIG. 2B is a bottom plan view of the embodiment shown in FIG. 2A.
Figure 2A:
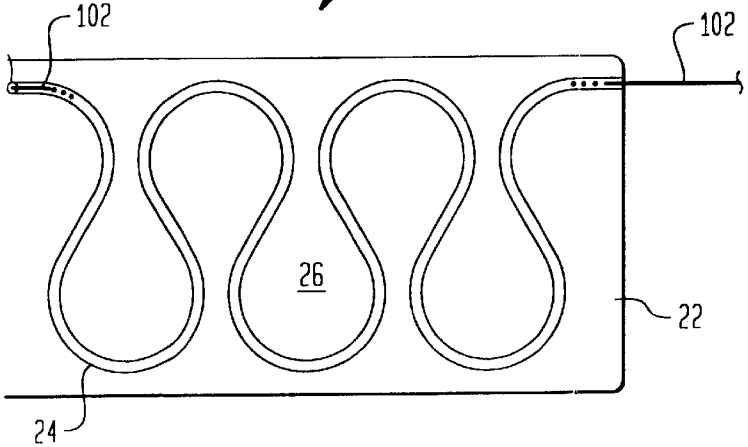
FIG. 2A is a top plan view of another embodiment of the line storage device.

Referring simultaneously to FIGS. 2A and 2B, block 22 has zigzag channel 24 formed in top surface 26 as illustrated in FIG. 2A. Channel 24 terminates at a feed through hole 28 that passes through to bottom surface 27 into which zigzag channel 25 is formed as illustrated in FIG. 2B. Since line 102 must still extend from opposing ends of block 20, line 102 is led across block 20 by a straight channel 29 in bottom surface 27. By using feed through hole 28 to carry line 102 to its next layer of channel, all of line 102 is kept within and protected by block 102. Alternatively, line 102 can be led outside of block 102 to the next layer.

The advantages of the present invention are numerous. As purely a line storage device, the present invention provides for ease of handling excess line. As a line payout control device, the present invention ensures that no slack develops during payout of the line by holding the line in a frangible package that ruptures in accordance with the sequential storing/payout of the line. Thus, line snags or entanglement during deployment of a line charge system are eliminated thereby providing a high degree of confidence in terms of line charge placement and detonation.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A line storage device for preventing a line from becoming entangled, comprising:

at least one piece of material formed with a channel that receives a line therein, said channel defining a non-overlapping zigzag pattern wherein the line extends from opposing ends of said at least one piece, said at least one piece supporting the line in said channel, wherein said at least one piece ruptures sequentially along said zigzag pattern from each of said opposing ends when the line achieves a threshold tension.

2. A device as in claim 1 wherein said channel is sized for press-fit engagement with the line.

3. A device as in claim 1 further comprising means for securing the line in said channel until said threshold tension is achieved.

4. A device as in claim 3 wherein said channel is formed in a surface of said at least one piece and wherein said means for securing is tape covering said channel and adhered to said surface.

5. A device as in claim 1 wherein said material is polystyrene.

6. A device as in claim 1 wherein said at least one piece is solid.

7. A device as in claim 1 wherein said channel is layered in said at least one piece.

8. A line storage device for preventing a line from becoming entangled, comprising:

at least one piece of material having opposing first and second surfaces formed with corresponding first and second channels that receive a line therein, each of said first and second channels defining a non-overlapping zigzag pattern;

means for leading the line from said first channel in said first surface to said second channel in said second surface wherein the line extends from opposing ends of said at least one piece; and said at least one piece supporting the line in said first channel and said second channel, wherein said at least one piece ruptures sequentially along said zigzag pattern at said first surface and said second surface when the line achieves a threshold tension.

9. A device as in claim 8 wherein said first channel and said second channel are sized for press-fit engagement with the line.

10. A device as in claim 8 further comprising means for securing the line in said first channel and said second channel until said threshold tension is achieved.

11. A device as in claim 10 wherein said means for securing is tape covering said first channel and said second channel, said tape further being adhered to said first surface and said second surface.

12. A device as in claim 8 wherein said material is polystyrene.

13. A device as in claim 8 wherein said at least one piece is solid.

14. A device as in claim 8 wherein said means for leading comprises a feed hole passing through said at least one piece and coupling said first channel to said second channel.

15. A line storage device for preventing entanglement of a line attached on a first end thereof to a propulsion unit and attached on a second end thereof to a distributed mass wherein, when the propulsion unit causes the line to be in tension at the distributed mass, a standing wave is created in the line, said line storage device, comprising:

at least one piece of material having at least one surface thereof formed with a channel that receives a portion of the line therein, said channel defining a non-overlapping zigzag pattern wherein said portion of the line extends from opposing ends of said at least one piece, said material supporting said portion of the line in said channel, wherein said at least one piece absorbs energy from the standing wave as said at least one piece ruptures sequentially along said zigzag pattern from each of said opposing ends when the line achieves a threshold tension.

16. A device as in claim 15 wherein said channel is sized for press-fit engagement with the line.

17. A device as in claim 15 further comprising means for securing said portion of the line in said channel until said threshold tension is achieved.

18. A device as in claim 17 wherein said means for securing is tape covering said channel and adhered to said at least one surface.

19. A device as in claim 15 wherein said material is polystyrene.

20. A device as in claim 15 wherein said at least one piece is solid.

21. A device as in claim 15 wherein said at least one piece has opposing first and second surfaces formed with corresponding first and second channels that receive the line therein, each of said first and second channels defining corresponding first and second non-overlapping zigzag patterns, and said device further comprising means for leading the line from said first channel in said first surface to said second channel in said second surface.

22. A device as in claim 21 wherein said means for leading comprises a feed hole passing through said at least one piece and coupling said first channel to said second channel.

* * * * *